US006996887B2

(12) United States Patent
Haas et al.

(10) Patent No.: US 6,996,887 B2
(45) Date of Patent: Feb. 14, 2006

(54) METHOD OF FABRICATING A TREAD PLATE HAVING ALTERNATING STRIPES INCORPORATED THEREON

(75) Inventors: Clarence J. Haas, North Royalton, OH (US); Raymond C. Buckley, Rocky River, OH (US)

(73) Assignee: Sure-Foot Industries Corporation, Cleveland, OH (US)

( * ) Notice: Subject to any disclaimer, the term of this patent is extended or adjusted under 35 U.S.C. 154(b) by 185 days.

(21) Appl. No.: 10/673,974

(22) Filed: Sep. 30, 2003

(65) Prior Publication Data

US 2005/0066512 A1 Mar. 31, 2005

(51) Int. Cl.
*B23P 25/00* (2006.01)

(52) U.S. Cl. ..... 29/458

(58) Field of Classification Search ..... 29/458, 29/459, 460, 428; 428/98, 105, 109, 144
See application file for complete search history.

(56) References Cited

U.S. PATENT DOCUMENTS 4,019,931 A * 4/1977 Setzer et al. ..... 148/549

* cited by examiner

*Primary Examiner*—John C. Hong
(74) *Attorney, Agent, or Firm*—James A. Hudak

(57) ABSTRACT

A method of fabricating a tread plate having alternating stripes incorporated thereon is disclosed. The tread plate is comprised of a base plate typically formed from a metallic extrusion. Alternating stripes of resinous material are placed on the base plate and are angularly positioned thereon with respect to the longitudinal axis of the base plate. The alternating stripes of resinous material have a coloring pigment incorporated therein permitting the alternating stripes of resinous material to provide a visual warning to individuals of the existence of a potentially hazardous condition or situation when the tread plate is installed in a particular location.

9 Claims, 4 Drawing Sheets

Fig. 3
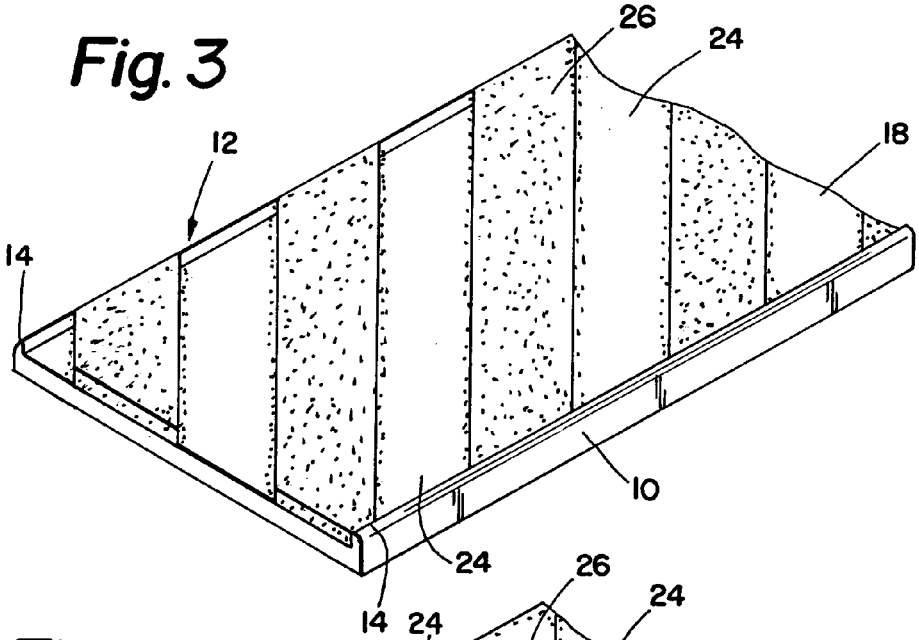
Fig. 4
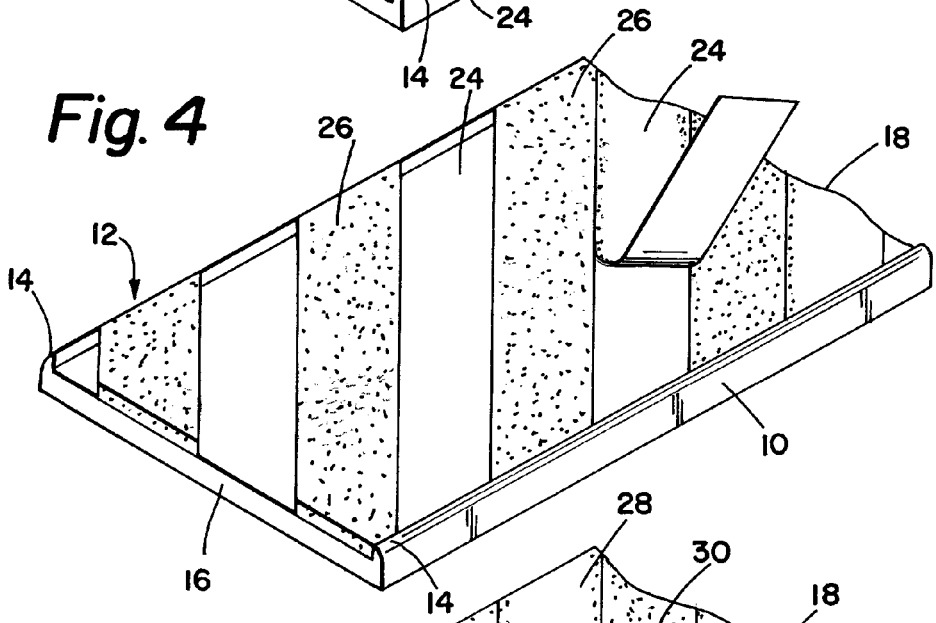
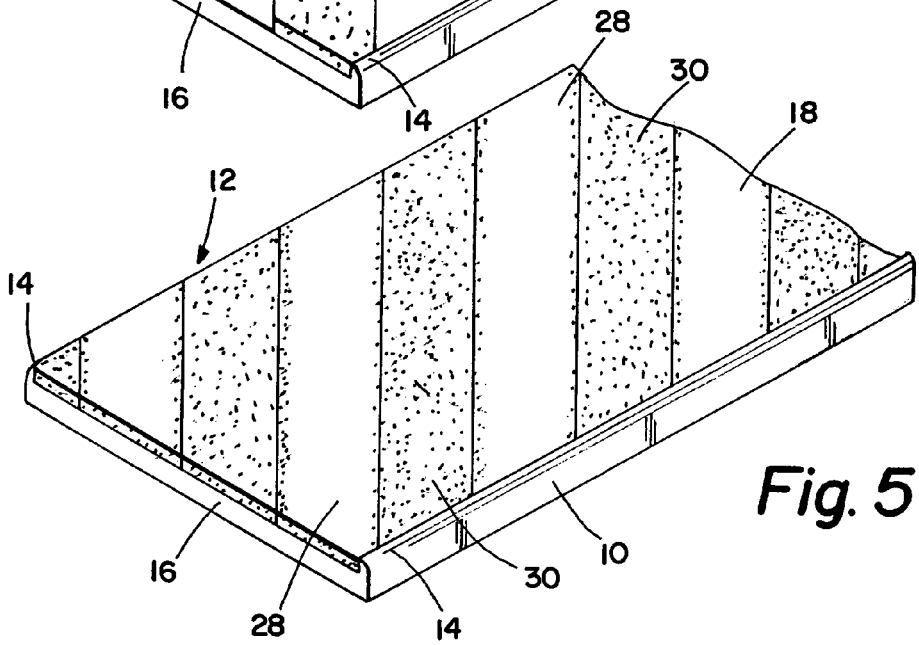
Fig. 5

METHOD OF FABRICATING A TREAD PLATE HAVING ALTERNATING STRIPES INCORPORATED THEREON

TECHNICAL FIELD

The present invention relates, in general, to a tread plate that can be utilized to warn individuals of a potentially hazardous condition or situation and, more particularly, to a tread plate that incorporates alternating warning stripes thereon.

BACKGROUND ART

Various types of devices are available to warn individuals of the existence of a potentially hazardous condition or situation, such as a change in the elevation of a surface on which individuals are walking. In such instances, a self-adhesive tape may be placed on the surface adjacent the area where the elevation of the surface occurs. Alternatively, such a tape may be utilized to segregate or "set-off" a particular area. In any event, the tape may have alternating yellow and black stripes on the surface thereof and the stripes can be oriented on a diagonal with respect to the longitudinal axis of the tape. Yellow and black alternating stripes are typically utilized since they suggest to the individual that a potentially hazardous condition or situation exists. Since the tape is applied directly to the surface on which the individuals are walking, it can be easily torn through wear. In view of this, it has become desirable to develop a tread plate having such alternating stripes incorporated thereon. Such a tread plate can be installed directly onto the surface on which the individuals are walking so as to warn the individuals of the existence of a potentially hazardous condition or situation. The tread plate would provide a firm base for the alternating stripes thus minimizing the effects of wear from individuals walking thereon.

SUMMARY OF THE INVENTION

The present invention relates to a method of fabricating a tread plate having alternating stripes incorporated thereon. As such, the present invention is directed to a tread plate comprising a base plate formed from an aluminum extrusion that is cut to the desired length. After being cut to the desired length, the top edge of the base plate is marked in equal increments. An angle indicator is positioned adjacent each of the increment markings on the top edge of the base plate and a line is scribed from the top edge to the bottom edge of the base plate along the predetermined angle. Masking tape is then placed in every other resulting incremental space on the base plate and the untaped areas of the base plate are filled with yellow, or any other desired color, resinous material which may have aggregate or grit particles therein to provide an abrasive surface. The masking tape is then removed from the incremental spaces on the base plate revealing diagonally oriented stripes of yellow resinous material. After the yellow resinous material has cured, masking tape is placed thereon and the spaces between adjacent stripes of yellow resinous material are filled with black, or any other desired color, resinous material which may have aggregate or grit particles therein to provide an abrasive surface. The masking tape on the stripes of yellow resinous material is then removed revealing diagonally oriented alternating stripes of yellow and black resinous material on the base plate. The base plate with the alternating stripes of yellow and black resinous material thereon can then be installed where required to warn individuals of the existence of a potentially hazardous condition or situation.

BRIEF DESCRIPTION OF THE DRAWINGS

FIG. 3 is a partial perspective view of the tread plate of the present invention showing the placement of the yellow resinous material between the strips of tape placed on the tread plate.

FIG. 4 is a partial perspective view of the tread plate of the present invention illustrating the removal of the strips of tape between adjacent stripes of yellow resinous material on the tread plate.

FIG. 5 is a partial perspective view of the tread plate of the present invention showing the placement of strips of tape on the stripes of yellow resinous material that have been placed on the tread plate.

DESCRIPTION OF THE PREFERRED EMBODIMENT

The present invention is directed to a tread plate having a plurality of alternating stripes thereon to warn individuals of the existence of a potentially hazardous condition or situation, such as a change in the elevation of the surface on which the individuals are walking. The stripes are formed from anti-slip resinous material and are typically oriented on an angle with respect to the longitudinal axis of the tread plate. In addition, the stripes can be colored by adding a coloring pigment to the resinous material. For example, in the present invention, alternating yellow and black stripes, oriented on an angle, such as 45°, with respect to the longitudinal axis of the tread plate on which they are placed, are utilized. The yellow resinous material comprises a mixture of one or more grades of aggregate or grit particles with a yellow coloring pigment added thereto; whereas the black resinous material comprises a mixture of one or more grades of aggregate or grit particles with a black coloring pigment added thereto. Yellow and black have been selected as the colors of the resinous material to be used in this instance since alternating yellow and black stripes are typically used to warn pedestrians of the existence of a potentially hazardous condition or situation, such as a change in the elevation of a walking surface. It should be noted, however, that any color can be used for the alternating stripes of resinous material since the color of the stripes is determined by the coloring pigment that is mixed with the resinous material.

Figure 1:
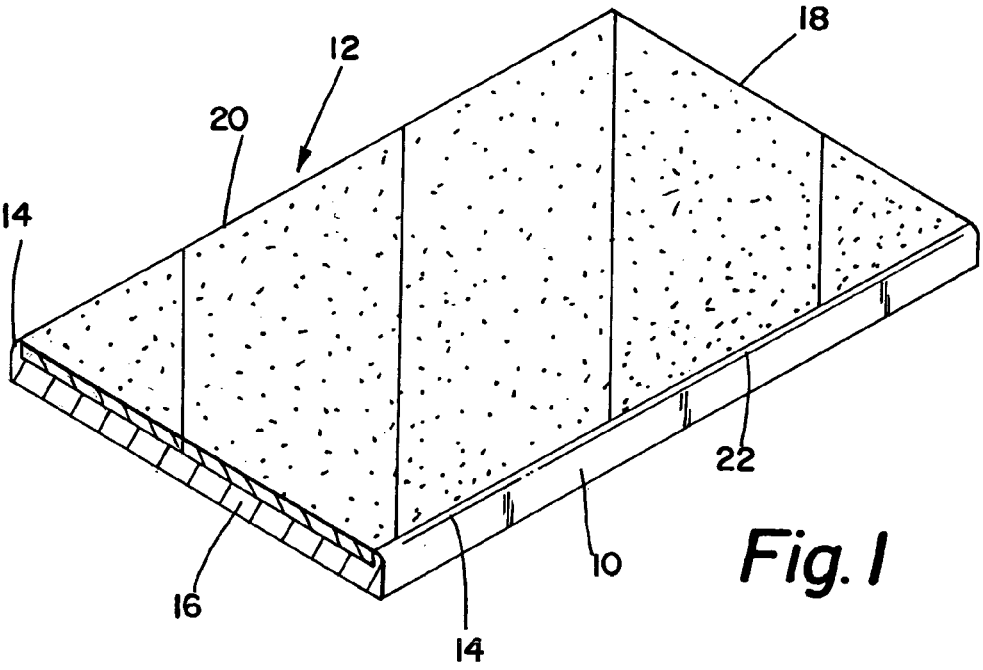
FIG. 1 is an enlarged perspective view of the tread plate of the present invention illustrating the stripes incorporated thereon.
Figure 2:
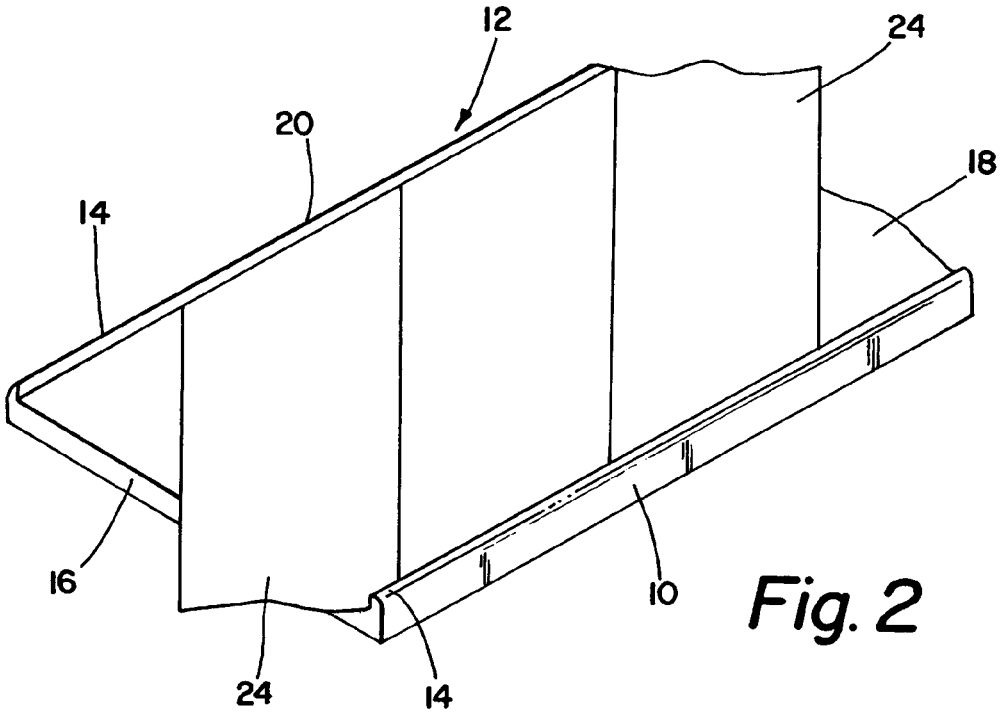
FIG. 2 is an enlarged partial perspective view of the tread plate of the present invention illustrating the placement of strips of tape thereon to define areas in which a yellow resinous material is to be placed.

Referring now to the Figures where the illustrations are for the purpose of describing the preferred embodiment of the present invention and are not intended to limit the invention described therein, FIG. 1 is a perspective view of a base plate 10 which acts as the backing for the tread 12 of the present invention. The base plate 10 is typically fabricated from an aluminum extrusion and has oppositely disposed, upwardly directed lips 14 along its longitudinally extending edges. The base plate 10 is cut to the length of the tread surface that is desired. After the base plate 10 has been cut to length, the surface thereof is cleaned with a fine wire mesh or steel wool pad. After cleaning with the wire mesh or steel wool pad, the opposite ends 16 and 18 of the base plate 10 are machined to remove any burrs. The base plate 10 is then placed on a supporting surface and its longitudinal axis is aligned with a reference line on the supporting surface. The top edge 20 of the base plate 10 is then marked in equal increments, such as 3 inches, 4 inches, etc., starting at the right hand corner of the base plate 10. Using an angle indicator, such as a triangle, the triangle is positioned adjacent each of the increment markings on the top edge of the base plate 10 and a line is scribed from the top edge 20 to the bottom edge 22 of the base plate 10 along the predetermined angle, such as 45°, 60°, etc. A covering 24, such as masking tape, is then placed in every other resulting incremental space on the base plate 10 starting with the first incremental space to the left of the upper right hand corner on the top edge 20 of the base plate 10, as shown in FIG. 2. The uncovered areas on the base plate 10 are then filled with the aforementioned yellow resinous material 26, as shown in FIG. 3, and leveled. The covering 24 is then removed from the incremental spaces on the base plate 10 revealing diagonally oriented stripes of yellow resinous material 26, as shown in FIG. 4, on the base plate 10. Any holes in the yellow resinous material are then filled. In addition, the diagonally formed edges defining the stripes of yellow resinous material 26 are cleaned so that the edges are clearly defined. The yellow resinous material 26 is then allowed to cure for 12 to 24 hours.

Figure 6:
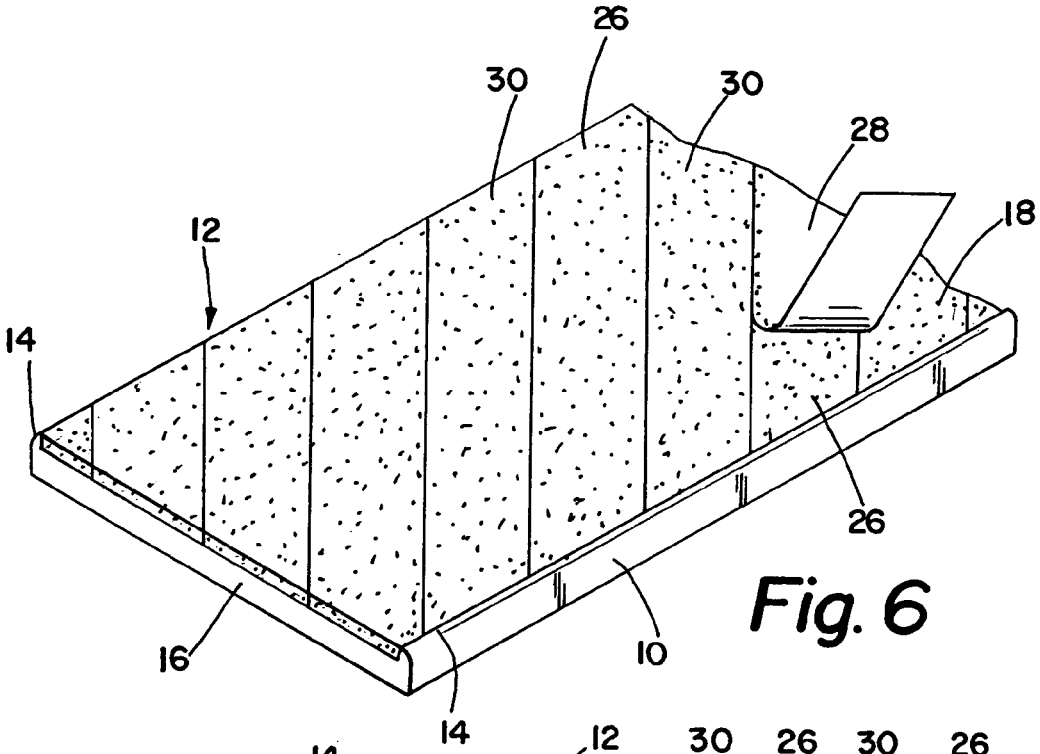
FIG. 6 is a perspective view showing the placement of black resinous material between the stripes of yellow resinous material and further showing the removal of the strips of tape from the stripes of yellow resinous material after the placement of the black resinous material on the tread plate.

After the stripes of yellow resinous material 26 have been cured, a covering 28, such as masking tape, is applied to the surface of the stripes of the yellow resinous material 26 on the base plate 10, as shown in FIG. 5. The spaces between adjacent stripes of yellow resinous material 26 are then filled with the aforementioned black resinous material 30 and leveled. After the black resinous material 30 has been applied to the spaces between adjacent stripes of yellow resinous material 26, the covering 28 on the stripes of yellow resinous material 26 is removed, as shown in FIG. 6, revealing diagonally oriented alternating stripes of yellow and black resinous material 26, 30 on the base plate 10. Any holes in the black resinous material 30 are then filled. The black resinous material 30 is then allowed to cure for 12 to 24 hours.

After the black resinous material 30 has cured, mounting holes, if required, are drilled through the resinous material and the base plate 10. The bottom surface of the base plate 10 can then be deburred adjacent any holes which have been drilled therethrough. The finished tread 12 is then washed. The tread 12 is allowed to dry for several days to ensure that any chemicals in the wash water do not stain the tread surface.

Figure 7:
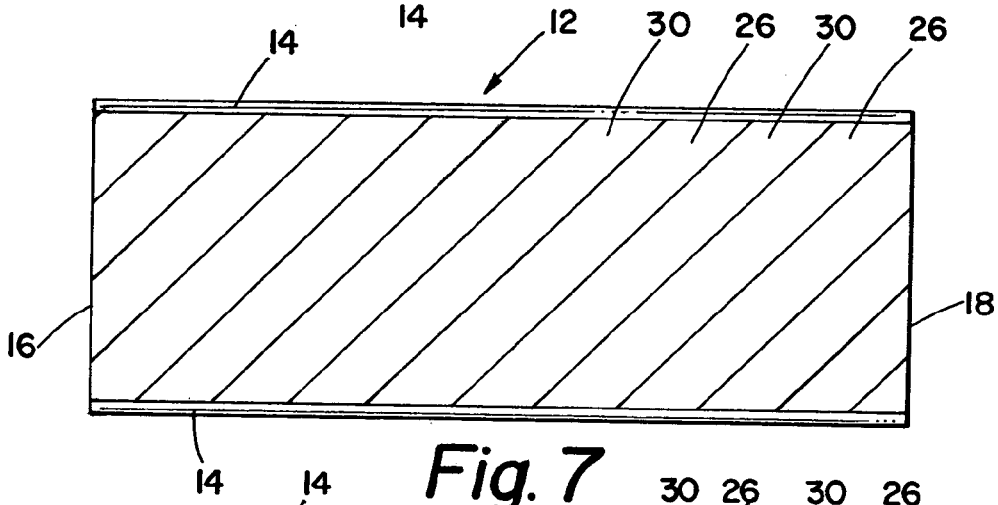
FIG. 7 is a top plan view of the tread plate of the present invention showing alternating stripes of yellow and black resinous material thereon at an angle of approximately 45° with respect to the longitudinal axis of the tread plate.
Figure 8:
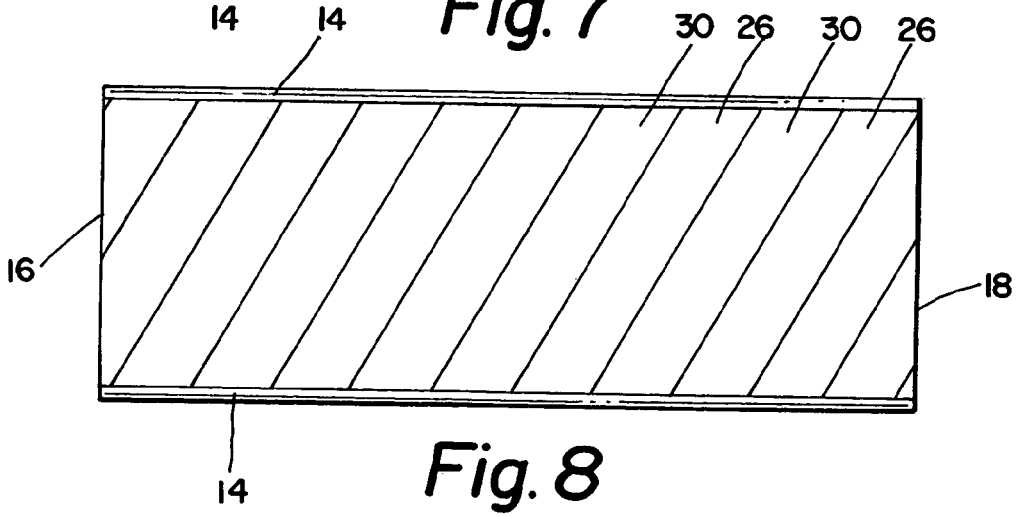
FIG. 8 is a top plan view of the tread plate of the present invention showing alternating stripes of yellow and black resinous material thereon at an angle of about 60° with respect to the longitudinal axis of the tread plate.
Figure 9:
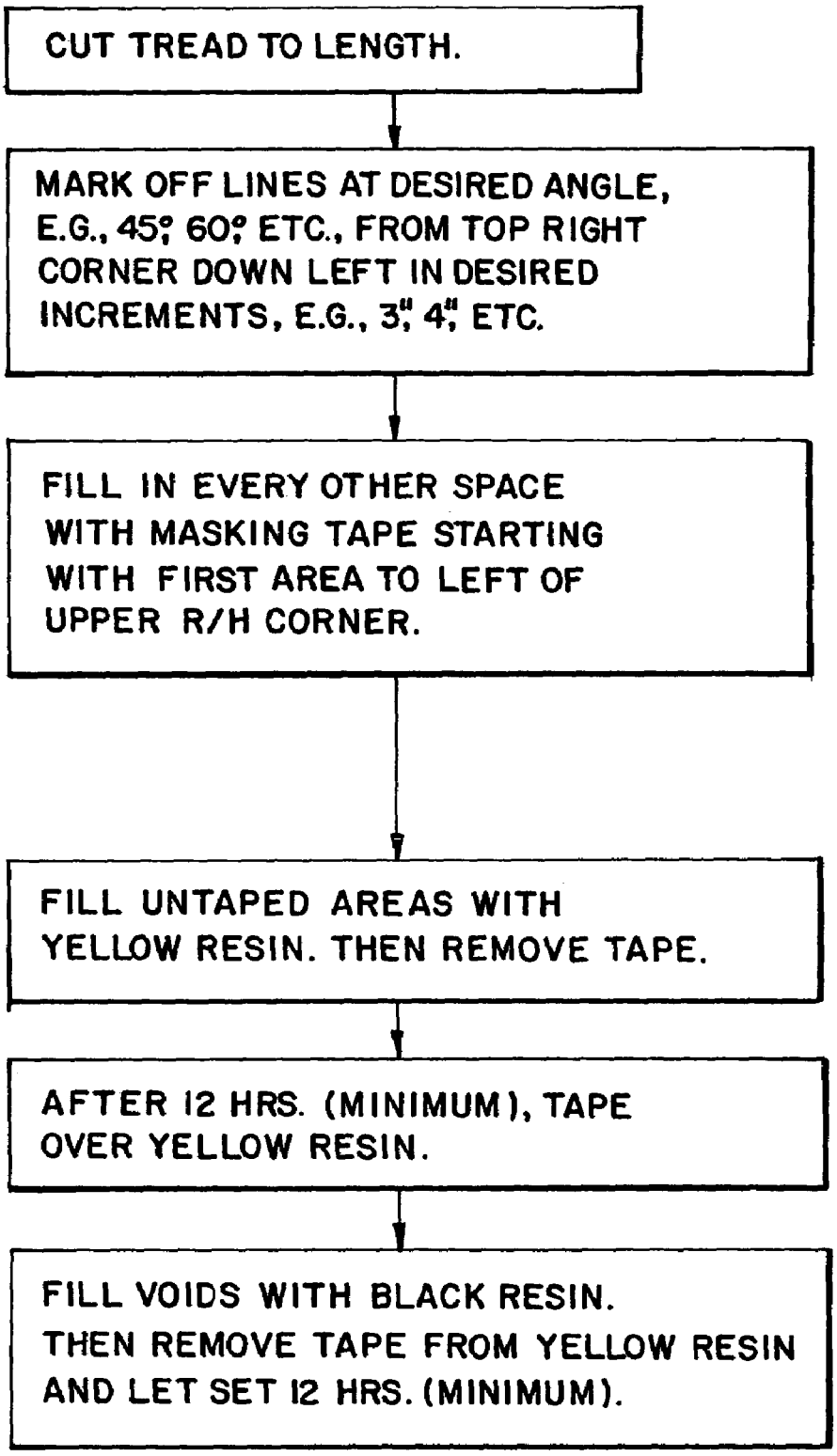
FIG. 9 is a flow chart illustrating the method of defining the position of the stripes of resinous material on the tread plate of the present invention and further setting forth the method of placing the yellow resinous material and the black resinous material on the tread plate.

The foregoing method of fabricating the tread 12 of the present invention is provided in "flow-chart" form in FIG. 9. It should be noted that the spacing of the stripes of resinous material 26, 30 on the base plate 10 can be in any equal increment, such as 3 inches, 4 inches, etc. It should also be noted that the stripes of resinous material 26, 30 can be placed on the base plate 10 at any angle with respect to the longitudinal axis of the base plate 10, such as 45°, as shown in FIG. 7, or 60°, as shown in FIG. 8. In addition, the color(s) of the resinous material 26, 30 can be readily changed by changing the coloring pigment that is added to the mixture of the resinous material and the aggregate or grit particles.

Certain modifications and improvements will occur to those skilled in the art upon reading the foregoing. It is understood that all such modifications and improvements have been deleted herein for the sake of conciseness and readability but are properly within the scope of the following claims.

We claim:

1. A method of fabricating a tread plate having alternating stripes incorporated thereon comprising the steps of:

a) Marking an edge of the tread plate in predetermined substantially equal increments;

b) Positioning an angle indicator adjacent each of said predetermined substantially equal increment markings on said edge of the tread plate;

c) Scribing a line along a predetermined angle defined by said angle indicator from each of said predetermined substantially equal increment markings on said edge of the tread plate to the opposite edge of the tread plate so as to define incremental spaces of substantially equal area on the tread plate;

d) Placing a covering in every alternating incremental space on the tread plate;

e) Filling uncovered areas on the tread plate with a first resinous material;

f) Removing said covering from said alternating incremental spaces on the tread plate so as to reveal angularly oriented stripes of said first resinous material on the tread plate;

g) Placing a covering on the surface of said angularly oriented stripes of said first resinous material on the tread plate;

h) Filling the spaces between said angularly oriented stripes of said first resinous material with a second resinous material; and i) Removing said covering from the surface of said angularly oriented stripes of said first resinous material.

2. The method as defined in claim 1 further including, before step a), the step of cutting the tread plate to a predetermined desired length.

3. The method as defined in claim 1 further including, between steps f) and g), the step of curing said first resinous material.

4. The method as defined in claim 1 further including, after step i), the step of curing said second resinous material.

5. The method as defined in claim 4 further including the step of drilling holes through said resinous material and the tread plate after the step of curing said second resinous material.

6. The method as defined in claim 1 wherein said first resinous material has a yellow coloring pigment incorporated therein.

7. The method as defined in claim 1 wherein said second resinous material has a black coloring pigment incorporated therein.

8. The method as defined in claim 1 wherein said first resinous material has aggregate provided therein to form an abrasive surface.

9. The method as defined in claim 1 wherein said second resinous material has aggregate provided therein to form an abrasive surface.

* * * * *